US010139097B2

(12) United States Patent
Qin

(10) Patent No.: US 10,139,097 B2
(45) Date of Patent: Nov. 27, 2018

(54) SOLID-STATE LIGHT SOURCE HEAT DISSIPATION METAL SHELL AND LIGHT SOURCE ENGINE, THE MANUFACTURING METHODS THEREOF, AND MOLD

(71) Applicant: Shenzhen Qin Bo Core Technology Development Co., Ltd., Shenzhen (CN)

(72) Inventor: Biao Qin, Shenzhen (CN)

( * ) Notice: Subject to any disclaimer, the term of this patent is extended or adjusted under 35 U.S.C. 154(b) by 527 days.

(21) Appl. No.: 14/772,134

(22) PCT Filed: Jan. 15, 2014

(86) PCT No.: PCT/CN2014/070650
§ 371 (c)(1),
(2) Date: Sep. 2, 2015

(87) PCT Pub. No.: WO2014/134977
PCT Pub. Date: Sep. 12, 2014

(65) Prior Publication Data

US 2016/0010841 A1 Jan. 14, 2016

(30) Foreign Application Priority Data

Mar. 4, 2013 (CN) ..... 2013 1 0086769
Apr. 2, 2013 (CN) ..... 2013 1 0134635

(51) Int. Cl.

| | |
|---|---|
| ***F21V 29/78*** | (2015.01) |
| ***F21V 29/00*** | (2015.01) |
| ***F21V 29/70*** | (2015.01) |
| ***F21V 29/74*** | (2015.01) |
| ***F21K 9/20*** | (2016.01) |
| ***F21K 9/68*** | (2016.01) |
| *F21Y 115/10* | (2016.01) |

(52) U.S. Cl.
CPC ..... *F21V 29/78* (2015.01); *F21K 9/20* (2016.08); *F21K 9/68* (2016.08); *F21V 29/2212* (2013.01); *F21V 29/70* (2015.01); *F21V 29/74* (2015.01); *F21Y 2115/10* (2016.08)

(58) Field of Classification Search
CPC ..... F21V 29/78; F21V 29/70; F21V 29/74; F21V 29/2212; F21K 9/20; F21K 9/68
USPC ..... 362/373
See application file for complete search history.

(56) References Cited

U.S. PATENT DOCUMENTS

| | | | | |
|---|---|---|---|---|
| 7,144,140 | B2 * | 12/2006 | Sun | F21K 9/233 362/373 |
| 7,874,710 | B2 * | 1/2011 | Tsai | F21V 29/004 362/294 |
| 8,444,299 | B2 * | 5/2013 | Chou | F21V 29/004 165/80.3 |
| 2008/0049399 | A1 * | 2/2008 | Lu | F21K 9/233 361/714 |

(Continued)

*Primary Examiner* — Byron T Gyllstrom
(74) *Attorney, Agent, or Firm* — Novoclaims Patent Services LLC

(57) ABSTRACT

The invention proposes a solid-state light heat dissipation metal shell (1) and a light-source engine, a. using the shell as a heat sink and adopting a metal plate to process and shape; b. optimizing the wall thickness of the heat dissipation metal shell (1); c. the side wall (2) is made by the stretch of the metal plate from a rear shell (9) or/and a front shell (4), and provided with a ventilation window (3) with a louver type or staggered structure; d. a reflecting cup (26) is provided to solve the glare problem. The invention also proposes a production method and a mold thereof.

20 Claims, 8 Drawing Sheets

(56) References Cited

U.S. PATENT DOCUMENTS

| | | | | |
|---|---|---|---|---|
| 2008/0266866 | A1* | 10/2008 | Tsai | F21V 29/004 362/294 |
| 2009/0141500 | A1* | 6/2009 | Peng | F21K 9/233 362/294 |
| 2010/0282446 | A1* | 11/2010 | Yamamoto | F21S 8/02 165/109.1 |
| 2010/0295436 | A1* | 11/2010 | Horng | F21V 29/02 313/46 |
| 2011/0037368 | A1* | 2/2011 | Huang | F21V 29/02 313/46 |
| 2011/0309734 | A1* | 12/2011 | Lin | F21V 29/004 313/46 |
| 2012/0187830 | A1* | 7/2012 | Shum | H05K 1/021 315/32 |

* cited by examiner

SOLID-STATE LIGHT SOURCE HEAT DISSIPATION METAL SHELL AND LIGHT SOURCE ENGINE, THE MANUFACTURING METHODS THEREOF, AND MOLD

BACKGROUND OF THE PRESENT INVENTION

Field of Invention

The invention relates to the field of solid-state light source heat dissipation and illumination, particularly to an outer shell being used as a heat sink for an solid-state light source radiator and a light-source engine Description of Related Arts The key obstacle to the popularity of LED lighting is the too expensive offer. The cost of LED lights can be divided into three parts: an LED light source, a power source and a structure, the structure comprises a radiator. The cost of the structure will be the main cost.

The reasons why the current structure has high cost are as follows: it lacks of proper theory and technology of "Heat Transfer Science", which are clearly demonstrated in the followings: 1. it is unclear that convection heat transfer is the key; 2. the basic principle of convection heat transfer is not understood, ensuring the smooth flow of air passing through a heat sink is a basic requirement for convection heat transfer.

Natural convection heat transfer is the best choice for the LED lighting. However, those skilled in the art generally do not know that the power-driven natural convection of air flow is very weak, ensuring the smooth air flow, especially the convection from the bottom to the top, is the most critical in the natural convection.

Currently, when heat dissipation metal shell is used as the heat sink for the LED lighting, a convection window is not provided on heat dissipation metal shell, even if the convection window is provided but the openings are not opened enough; the problem that the different installation angles of a light will affect the smooth flow of natural upward convection is not taken into account.

SUMMARY OF THE PRESENT INVENTION

The main object of the invention is to solve the problem of the high cost of the structure by using the shell of a lamp as an solid-state light source heat dissipation metal shell (a heat sink), and having an enough convection window opened on the shell for ensuring the smooth air flow through the shell.

Additional advantages and features of the invention will become apparent from the description which follows, and may be realized by means of the instrumentalities and combinations particularly point out in the appended claims.

The invention has the following solution for an solid-state light source heat dissipation metal shell: an heat dissipation metal shell includes a side wall and a front shell, or a side wall and a rear shell, or a side wall, a front shell and a rear shell, the heat dissipation metal shell is provided with a contact heat-transfer surface contacting an solid-state light source directly or indirectly, part or all of the heat generated by the solid-state light source is transferred to the surface of the heat dissipation metal shell through the contact heat-transfer surface and dissipated out.

The heat dissipation metal shell is characterized in that: the heat dissipation metal shell is made of metal plat by a punching process, the side wall is formed by the stretch of the metal plate of the rear shell, or the front shell, or the rear shell and the front shell; a ventilation window with an louver type structure or a staggered structure is provided on the side wall, a cut line of the ventilation window adopts a structure along the stretch direction of the side wall, the permeation ratio of the side wall is not less than 0.20; the rear shell is provided with a contact heat-transfer surface contacting the solid-state light source directly or indirectly; the front shell is provided with a contact heat-transfer surface contacting the solid-state light source directly or indirectly. The solid-state light source is generally provided with a heat conduction plate or a heat conduction core.

The contact heat-transfer surface of the invention is particularly a contact surface for ensuring heat conduction transfer, therefore, the contact surface shall be big enough and have the contact tight enough by taking the measures such as compression, interference fit, the addition of a thermally conductive adhesive or welding.

The side wall permeation rate is defined as the quotient obtained by the effective ventilation area of the ventilation window on the side wall divided by the area of the side wall, it will be defined in detail later.

A technical solution to solve the glare problem is proposed in the invention: the solid-state light source is provided with a reflecting cup, more than one half of the light from the solid-state light source irradiates on the reflecting surface of the reflecting cup and then is reflected out of the light-source engine.

The invention also proposes a method for producing the heat dissipation metal shell, being characterized in that: for the shaped method with a louver type or staggered structure ventilation window on the side wall, a shaped convex tooth moves axially, pushes a metal shell wall to be deformed inwardly, and thus an inwardly bent fin is formed and a ventilation opening with a louver type or staggered structure for the ventilation window is formed.

These and other objectives, features, and advantages of the invention will become apparent from the following detailed description, the accompanying drawings, and the appended claims.

DETAILED DESCRIPTION OF THE PREFERRED EMBODIMENT

Figure 1:
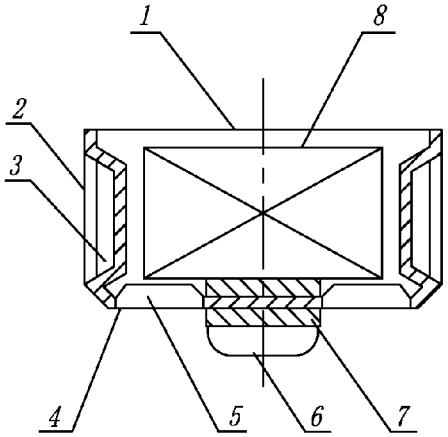
FIGS. 1, 2 and 5 are characteristic sectional diagrams of three kinds of a solid-state light source engine of the invention, respectively.

FIG. 1 shows a kind of solid-state light source engine of the invention, a side wall 2 and a front shell 4 of a heat dissipation metal shell 1 are made of the same metal plate, the heat dissipation metal shell 1 is provided therein with a heat sink 8, the side wall is provided with a ventilation window 3 of a staggered structure, a ventilation window 5 provided on the front shell 4 adopts a louver type structure, a solid-state light source 6 is set on a heat conduction plate 7, the heat conduction plate 7 is directly adhered to the middle of the front shell 4, the contact surface between the middle of the front shell 4 and the heat conduction plate 7 is a contact heat-transfer surface which is a direct contact heat-transfer surface herein.

Figure 2:
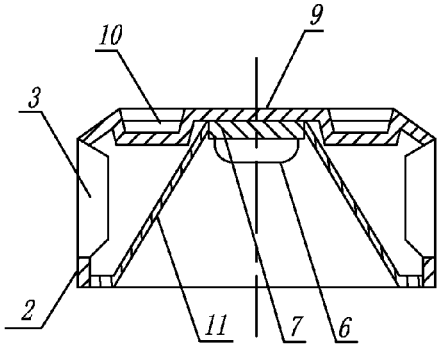

In FIG. 2, the side wall 2 and the rear shell 9 are made of the same metal plate, the middle of the rear shell 9 is provided with a contact heat-transfer surface directly contacting the heat conduction plate 7. The rear shell 9 is provided thereon with a ventilation window 10 with a staggered structure, the side wall 2 is provided with the ventilation window 3 with a louver type structure. The solid-state light source 6 is provided with a light-source cup 11.

Figure 3:
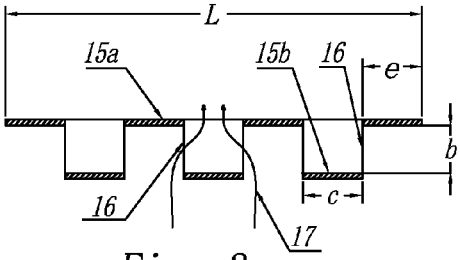
FIG. 3 is a characteristic sectional diagram of a kind of staggered structure ventilation window, wherein b is the width of an opening 16, c is the width of a fin 15*b* and e is the width of a fin 15*a*.

FIG. 3 shows a characteristic structure of a staggered structure ventilation window, a continuous metal-plate surface with the length of L is cut and punched into a plurality of fin 15*a* and fin 15*b*, the fins 15*a* and the fins 15*b* are staggered and arrayed, two ends of the punched sheet 15*b* shall be still connected with the original metal plate and shall not be cut off. In the figure, an air flow line 17 shows that air passes from one surface to the other surface from an opening 16.

Figure 4:
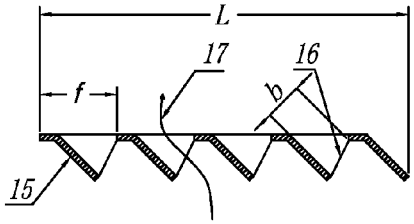
FIG. 4 is a characteristic sectional diagram of a kind of louver type structure ventilation window, wherein f is the distance between two opening cuts, and b is the width of a opening 16.
Figure 5:
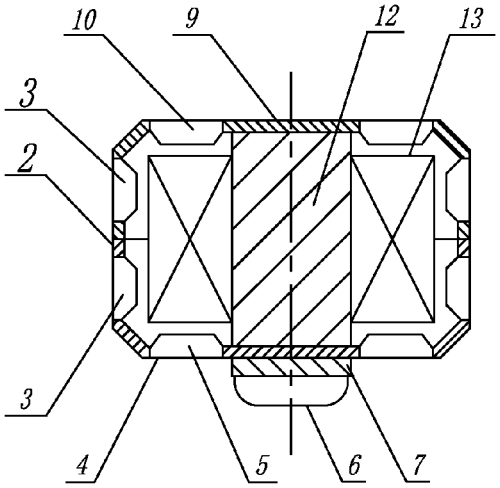

FIG. 4 shows the basic characteristic structure of a ventilation window with a louver type structure: the metal plate is cut, the metal sheet at the cut part is bent and forms a opening 16 (i.e. a ventilation opening). In the figure, the continuous metal plate with the length of L is cut and punched into five segments of the fins 15 with the distance f, two ends of the fin 15 should be still connected with a virgin metal plate and not be cut of, the air flow line 17 shows that air passes from one surface to the other surface from the opening 16.

in FIG. 5, the heat dissipation metal shell 1 includes the front shell 4 and the rear shell 9, the side wall 2 is divided into two segments which are formed by the stretch of the metal plate of the front shell 4 and the rear shell 9, respectively, the ventilation windows provided on the front shell 4, the rear shell 9 and the side wall 2 are a louver type structure. The heat dissipation metal shell 1 is still provided therein with a heat sink of which fins 13 extends out of a cylindrical surface of a heat conduction cylinder 12.

Figure 6:
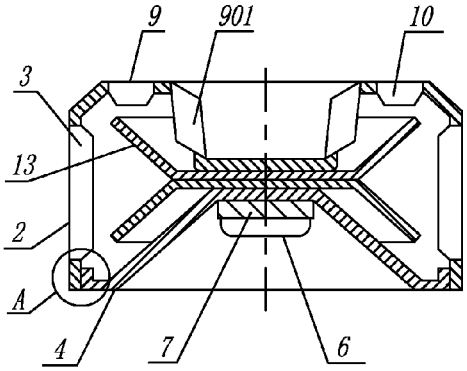
FIGS. 6, 7 and 8 are characteristic sectional diagrams of three kinds of solid-state light source engine of the invention, respectively.

In FIG. 6, the side wall 2 is formed by the stretch of the metal plate of the rear shell 9; the middle of the rear shell 9 is stretched forwards (according to the invention, the illuminating direction of the solid-state light source is defined as the forward direction, otherwise it is defined as the backward direction), an ventilation window 901 with a louver type structure is provided on a stretched wall, a staggered structure ventilation window can be also adopted; the front shell 4 adopts a structure which is stretched backwards, and can forms a light-source cup of the solid-state light source 6. The figure still shows that the heat dissipation metal shell 1 is provided therein with fin 13 with a lamination structure.

Figure 7:
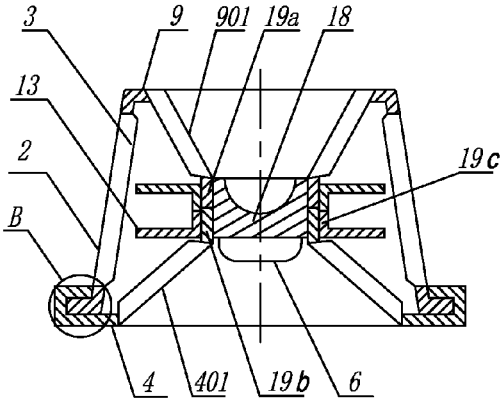

In FIG. 7, the rear shell 9 adopts a structure stretched forwards, a ventilation window 901 is provided on a stretched wall, a ventilation window 401 is also provided on the wall of the front shell which is stretched backwards, In the figure, the ventilation window 901 and 401 are a louver type structure (can also be a staggered structure). The cut lines of the ventilation window 401 and the ventilation window 901 on the stretched walls shall adopt the structure along the stretch direction of the stretched wall (it is also the axis direction of the heat dissipation metal shell 1). When the ventilation window is provided on the side wall of the heat dissipation metal shell and the front shell, the ratio of the sum of the effective ventilation area of the ventilation window on the side wall and that on the front shell against the ideal ventilation area of the rear shell shall not be less than 0.2.

In FIG. 7, the solid-state light source 6 is set on the front end surface of a heat conduction core 18, the middles of the front shell 4 and the rear shell 9 adopt a sleeve structure, Portion 19*b* of the front shell 4 and Portion 19*a* of the rear shell 9 are sleeved on the cylindrical surface of the heat conduction core 18, the contact surface between the portions 19*a*, 19*b* and the heat conduction core 18 is the contact heat-transfer surface. The heat dissipation metal shell 1 is provided therein with fin 13, the fin 13 adopts a sleeve structure, Portion 19*c* of the fin 13 is sleeved on Portion 19*b* of the front shell 4, the heat transferred into the fins 13 is transferred from Portion 19*c*.

Figure 8:
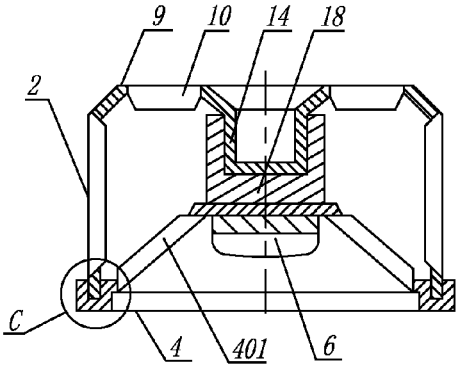

In FIG. 8, the middle of the rear shell 9 adopts a sleeve barrel structure, a sleeve barrel 14 is inserted into the heat conduction core 18, the contact surface between the sleeve barrel 14 and the heat conduction core 18 is the contact heat-transfer surface.

A fastening connection structure is provided between the edge of the side wall or the side-wall extending section and the edge of the front shell or the extending section of the front shell, the fastening connection can adopt welding, paste, buckle connection, interference fit connection, peripheral accessory pressing connection or clamping connection, the contact area therebetween shall be big enough for heat transfer.

FIG. 6 shows that the fastening connection between the edge of the side wall 2 and the edge of the front shell 4 adopts an interference fit structure, as is shown in the local part A of the figure. The outer diameter of the edge is bigger than the inner diameter of the edge of the side wall, the so called interference fit connection is that the side wall 2 forcibly sleeves onto the front shell 4. FIG. 7 and FIG. 8 show that the fastening connection between the edges of the side wall 2 and the front shell 4 adopts a buckle connection structure, as is shown in the local part B of FIG. 7 and the local part C of FIG. 8.

Figure 9:
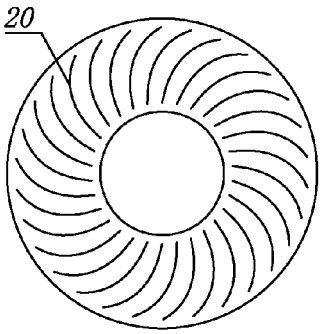
FIGS. 9, 10 and 11 are characteristic diagrams of three kinds of cut line with radiation-shaped structures, respectively. If the cut line 22 is not in the same plane, FIGS. 9-11 shall be projection or a top down schematic diagram.
Figure 10:
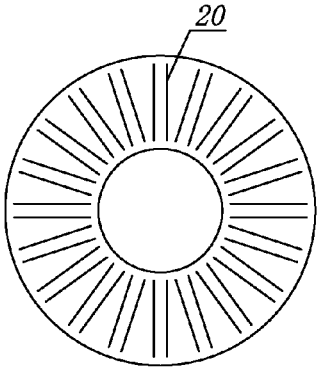
Figure 11:
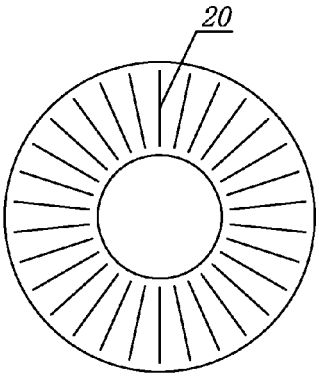

If the front shell, the rear shell and the fin heat sink are provided with the louver type or the staggered structure ventilation window, the cut line shall adopt a structure with a radiation shape, FIGS. 9, 10, 11 show three kinds of cut line 20 with the radiation shape respectively, the cut line 20 in FIG. 9 is an arc line shape, the cut line 20 in FIG. 10 and FIG. 11 is a straight line shape.

Figure 12:
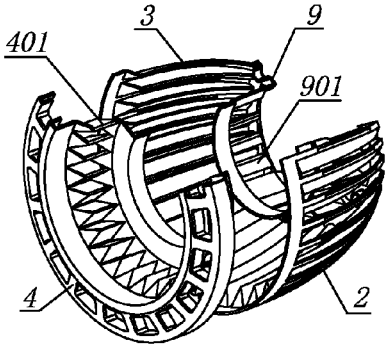
FIG. 12 is a perspective sectional explosive diagram of a kind of the heat dissipation metal shell of the invention.

The heat dissipation metal shell of the invention shown in FIG. 12 includes the front shell 4 and the rear shell 9, the side wall 2 is formed by the stretch of the metal material of the rear shell 9. The rear shell 9 adopts a structure stretched forwards, the ventilation window 901 with the louver type structure is provided on the stretched wall. The front shell 4 adopts a structure stretched backwards, a ventilation window 401 with the louver type is provided on the stretched wall. The figure shows that the cut line of the ventilation window on the stretched wall of the front shell 4 and the middle of the rear shell 9 is along the stretch direction of the stretched wall and is the same with the axis direction of the heat dissipation metal shell; the cut line of the ventilation window 3 on the side wall is also along the stretch direction, the ventilation window 3 also adopts a louver type structure.

Figure 13:
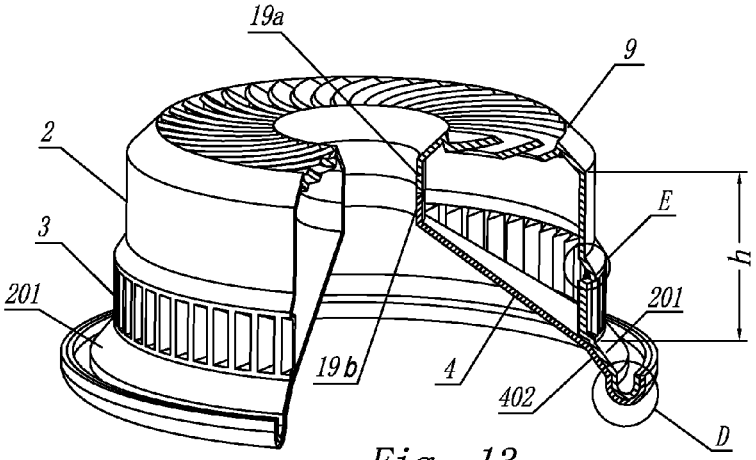
FIG. 13 is a perspective sectional diagram of a kind of the heat dissipation metal shell of the invention.

In FIG. 13, the middle of the front shell 4 and the rear shell 9 adopts the sleeve structure, see Portions 19*a* and 19*b*; the interference fit connection and the buckle connection are adopted between the front-shell extending section 402 of the front shell 4 and the side-wall extending section 201 of the side wall 2, as is shown in the local part D of the figure, the outer edge of the side-wall extending section 201 is processed into a structure with a C-shaped section or a U-shaped section, the outer edge of the front-shell extending section 402 packs the outer edge of the side-wall extending section 201, it belong to a buckle connection.

Figure 14:
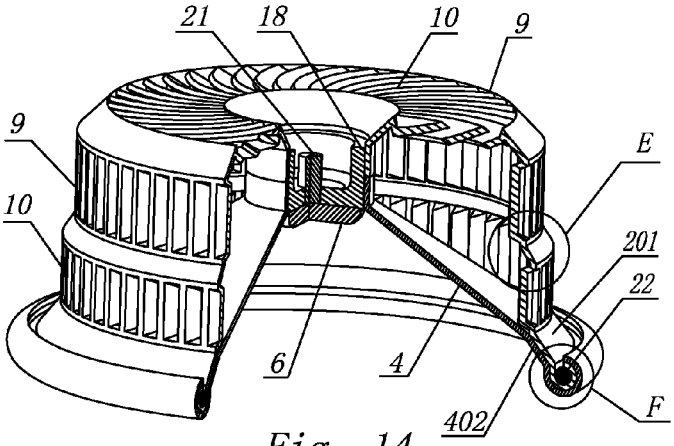
FIG. 14 is a perspective sectional diagram of a kind of the solid-state light source engine of the invention.

In FIG. 14, the outer edge of the side-wall extending section 201 is processed to have the C-shaped section, and provided with an inner reinforcing ring 22, as is shown in the local part F of the figure.

Figure 15:
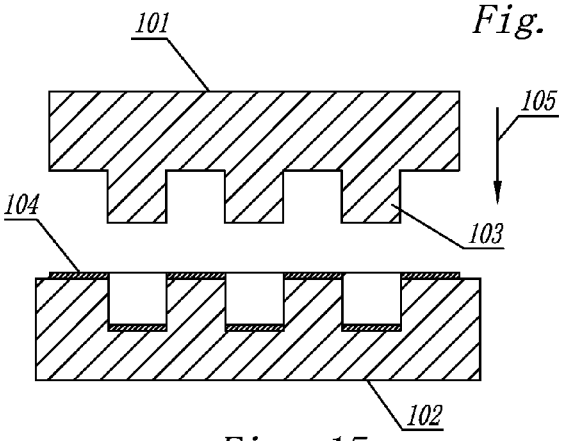
FIG. 15 is a characteristic sectional diagram of a mold of a general processing method of a staggered structure ventilation window.
Figure 16:
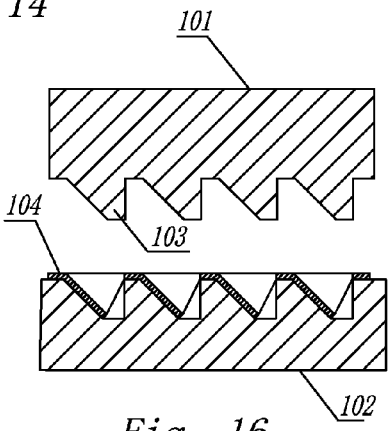
FIG. 16 is a characteristic sectional diagram of a mold of a general processing method of a louver type structure ventilation window.

FIG. 15 and FIG. 16 are diagrams of the general processing shaping methods of a louver type structure and a staggered structure, an upper mold 101 and a lower mold 102 are provided, the upper mold 101 is provided thereon with convex teeth 103, the movement of convex teeth 103 relative to the metal plate 104 is vertical (or subvertical), as is shown in Arrow 105. As the side wall of the shell of a lamp is generally in a barrel shape, if the side wall is provided thereon with the ventilation window with the above method (as is shown in FIGS. 13, 14), the production efficiency will be low. The invention proposes the following solution.

Figure 17:
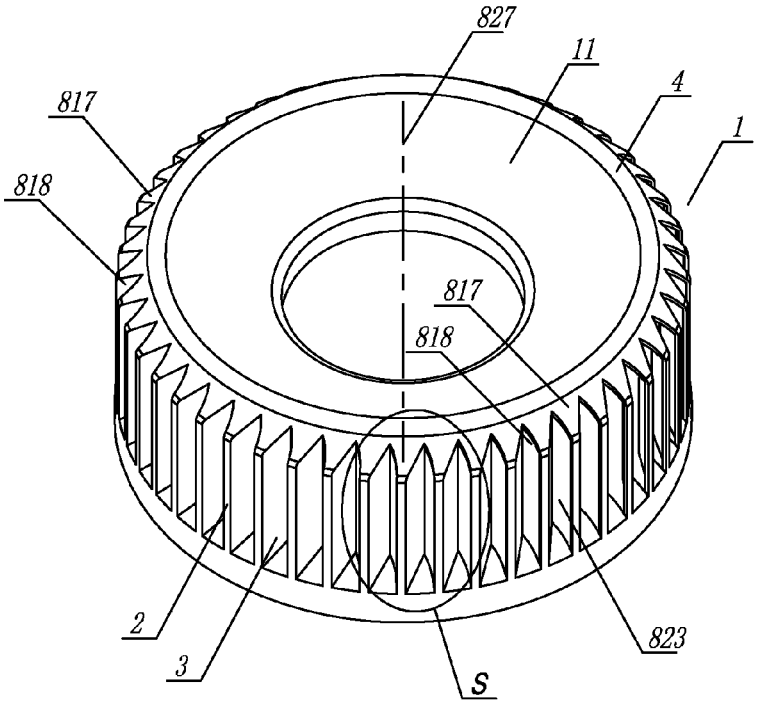
FIG. 17 is a perspective diagram of a kind of the heat dissipation metal shell of the invention, showing a structure feature of a louver type structure ventilation window on the side wall.
Figure 18:
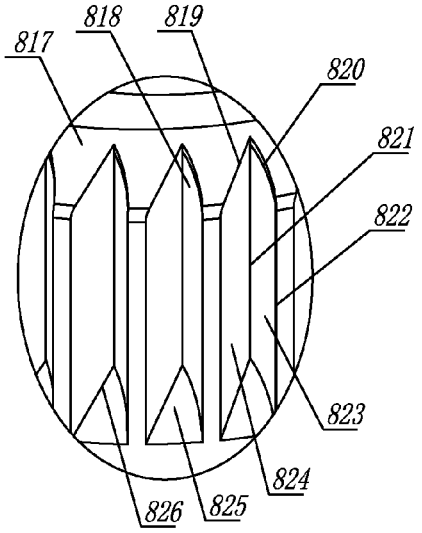
FIG. 18 is a partial enlarged diagram of the Part S in FIG. 17.

FIG. 17 shows a heat dissipation metal shell 1 of the invention, the ventilation window 3 on the side wall 2 is a louver type structure. An outer edge surface 817 is provided at the junction of the side wall 2 and the front shell 4, the outer edge surface 817 is provided thereon with a tooth notch 818 (which is formed by the axis punching of a shaped convex tooth). From FIG. 18 it can be clearly seen that the edge of the tooth notch 818 consists of an edge surface cut line 820 and a bend-edge 819, the edge surface cut line 820 is connected with a side wall cut line 822, an inwardly bent fin 824 is formed from the virgin metal plate of the shell wall which is cut and pushed by the shaped convex tooth inwards (forward the inside of the shell), so that an inwardly bent fin cut line 821 is separated from the side wall cut line 822 and the ventilation opening 823 is formed, the junction between the inwardly bent fin 824 and the outer edge surface 817 is the bend-edge 819, the other end (i.e. the lower end in the figure) of the inwardly bent fin 824 is connected with a lower end connection piece 825, the angle between them is called as a lower bend-edge 826. From FIG. 17, the side wall cut line 822 and the axis line 827 shall be in the same plane.

Figure 19:
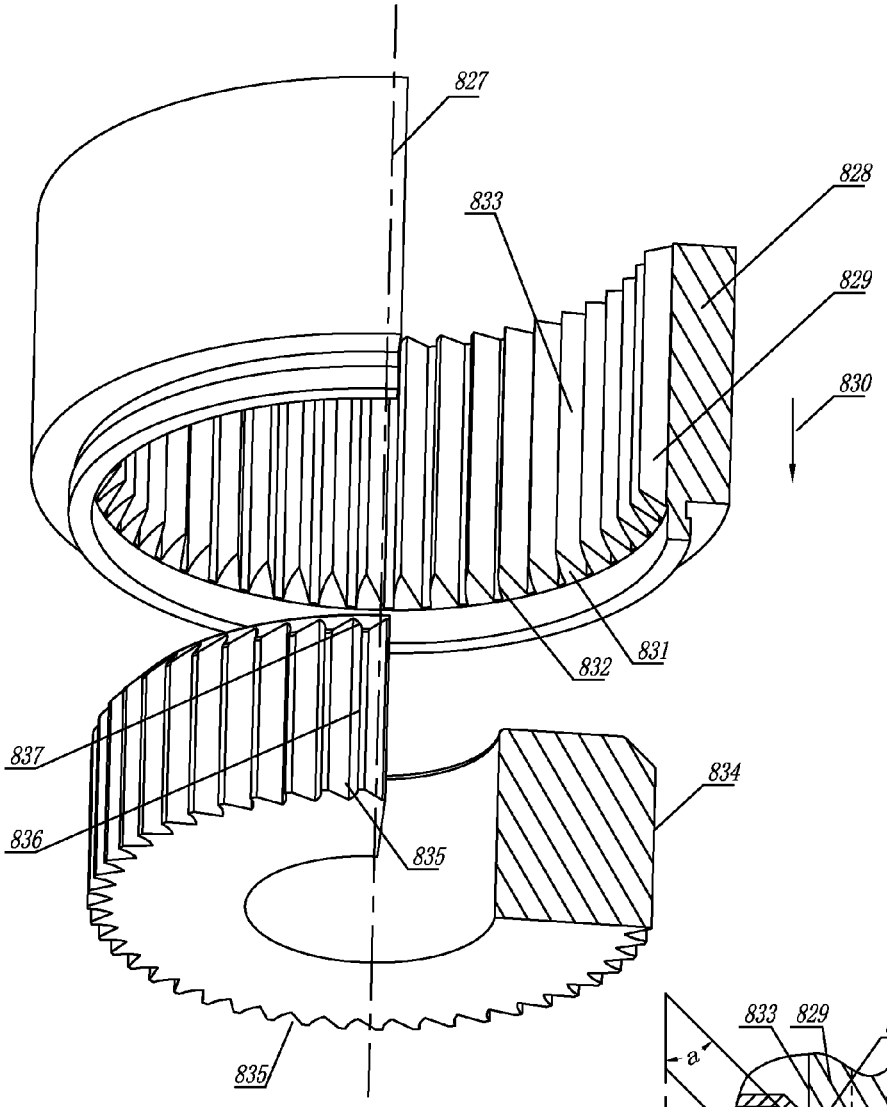
FIG. 19 is a characteristic structural diagram of a kind of the mold of a louver type structure ventilation window on a side wall of the invention.
Figure 20:
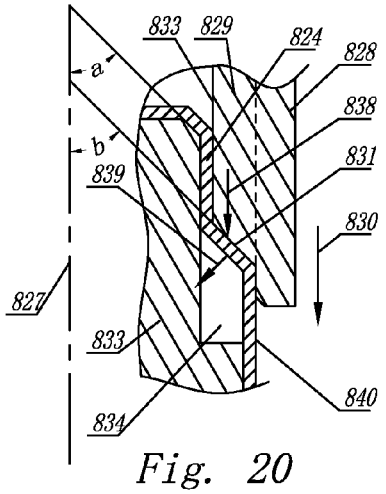
FIG. 20 is a characteristic diagram of showing a formation process of an inwardly bent fin on a side wall of the invention.

The mold shown in FIG. 19 shows the structure characteristics of a punched shaped mold of a louver structure ventilation window of the side wall of the invention: a concave mold 828 is the upper mold, the shaped convex tooth 829 is on an inner cavity wall of the concave mold 828, the figure shows that all of the shaped convex teeth 829 and the concave mold 828 are one integral structure, and can also be designed as a structure which is inlaid and fixed to be an integral body. The outer edge of the convex mold 834 is provided with a shaped groove 835 corresponding to the shaped convex tooth 829, the shaped groove 835 extends all along to the upper end of the convex mold 834 and forms an opening, the shaped convex tooth 829 can be inserted into the shaped groove 834 axially (the direction of the axis line 827 of the center axis of the convex mold 834 in the figure), as is shown by the arrow 830.

the convex tooth front surface 831 of the shaped convex tooth 824 is designed to be a sharp angle (a bevel angle) against the axis line 827, as is shown in FIG. 20, the convex tooth front surface 831 moves axially and downwards (Arrow 838), due to the bevel angle b ($b<90°$), the direction of the force of the convex tooth front surface 831 applied on the metal shell wall 840 is Arrow 839, the metal shell wall 840 is pushed inwards and constitutes the inwardly bent fin 824.

From FIG. 20, it can be seen that the shaped convex tooth 824 is provided thereon with a surface (which is called as a sliding friction surface 833) which slides and rubs relative to the inwardly bent fin 824, the convex-tooth front surface 831 is also a sliding friction surface. the included angle (b) between the convex-tooth front surface 831 and the axis line 827 generally adopts the range of 20°-70°, the most preferably the range of 40°-50°, meanwhile, the included angle (a) between the outer edge surface 817 and the axis line 827 shall be designed to be equal to or bigger than b ($a \geq b$), a shall be less than 90°, and adopts the range of 30°-70°.

FIG. 19 shows that the convex tooth front surface 831 has a convex tooth cutting edge 832, the convex mold 834 is provided thereon with the corresponding end surface cutting edge 837 and a side wall cutting edge 836, it shows that the mole shown in FIG. 19 can realizes that, a single mold station will complete the cutting process of the edge surface cut line 820 and the side wall cut line 822 on the heat dissipation metal shell 1 and the process that the shaped convex tooth 829 axially pushes the metal shell wall 840 to form the inwardly bent fin 824. The cutting process of the edge surface cut line 820 and the side wall cut line 822 as well as the process of the shaping of the inwardly bent fin 824 can also be carried out by two stations. From FIG. 19, the side wall cutting edge 836 and the axis line 827 shall be in the same plane for the shaped convex tooth 829 moving forward axially.

Figure 21:
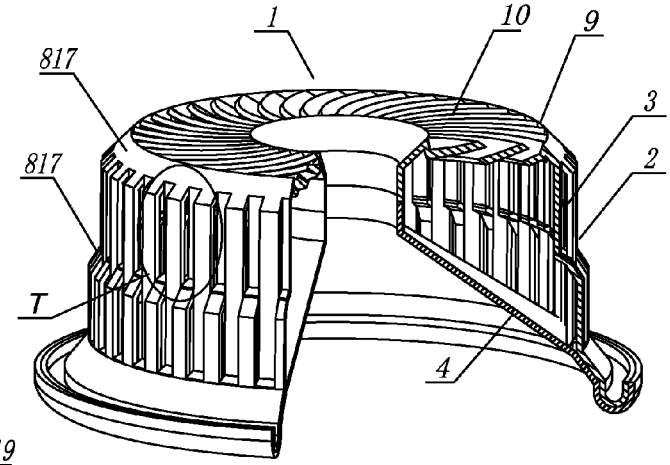
FIG. 21 is a perspective diagram of a kind heat dissipation metal shell of the invention.
Figure 22:
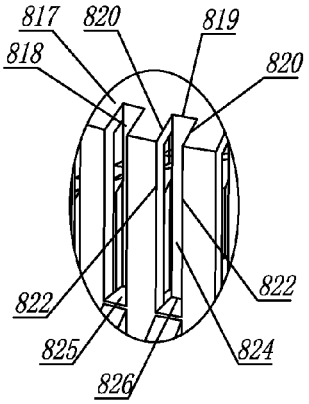
FIG. 22 is a partial enlarged diagram of the Part T in FIG. 21.

In FIG. 21, the front shell 4 and the rear shell 9 are provided, the side wall 2 and the rear shell 9 are made of the same metal plate. The rear shell 9 is provided thereon with the ventilation window 10 with a louver type structure. The side wall 2 is provided with the ventilation window 3 with a staggered structure and two outer edge surfaces 817. As is shown in FIG. 22, the edge of the tooth notch 818 on the outer edge surface 817 consists of two edge surface cut lines 820 and one bend-edge 819, each edge surface cut line 820 is connected with the side wall cut line 822 correspondingly. The upper end of the inwardly bent fin 824 is the bend-edge 819 while the lower end is the lower bend-edge 826.

Figure 23:
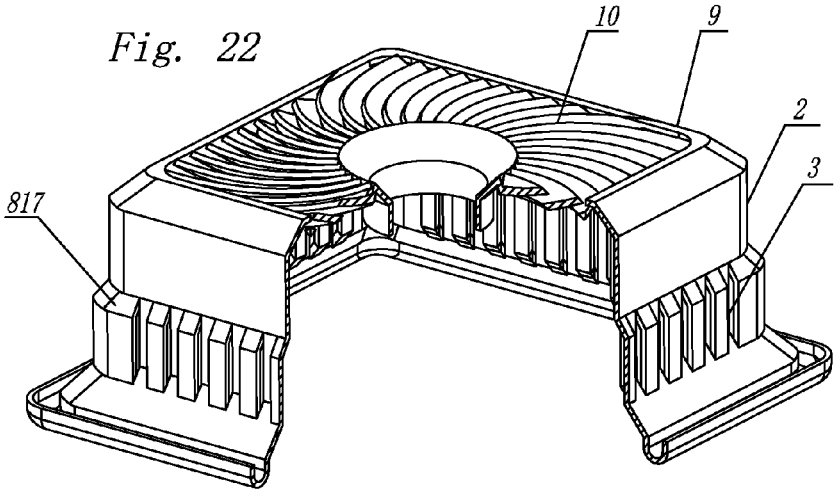
FIG. 23 is a perspective diagram of a kind heat dissipation metal shell of the invention.

The rear shell 9 and the side wall 2 shown in FIG. 23 of the invention have a square-shape cross section (which can also have an elliptical cross section, a polygon cross section, and even a triangular cross section). the ventilation window 10 on the rear shell 9 adopts the louver type structure, the cut line is an arc line, the figure shows that the ventilation window 3 on the side wall 9 adopts the staggered structure, only the lower half section of the side wall 2 is provided with the ventilation window 3, the outer edge surface 817 shall belong to the part of the side wall 2.

The invention proposes a technical solution to solve the glare problem: the solid-state light source is provided with a reflecting cup, more than one half of the light transmitted from the solid-state light source irradiates on the reflecting surface of the reflecting cup and is reflected out of the light-source engine from the reflecting cup. There are three concrete solutions.

Figure 24:
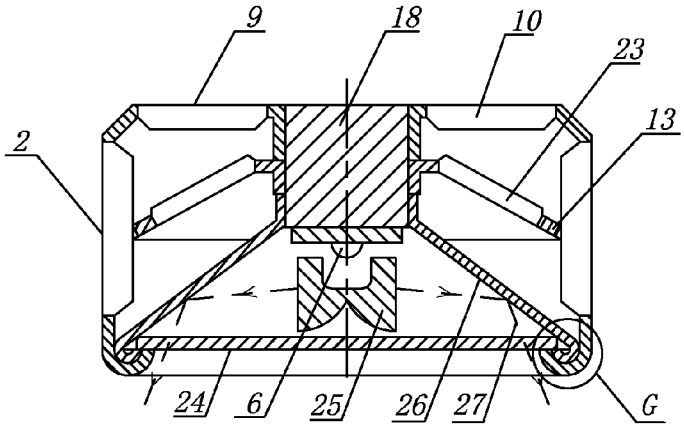
FIGS. 24-27 are characteristic diagrams of four kinds of light-source engine of the invention respectively, which use the technical solution for decreasing glare.

Embodiment 1 as is shown in FIG. 24, the solid-state light source 6 is a single lamp bead, the front side of the lamp bead is provided with a light distribution lens 25, more than one half of the light transmitted from the solid-state light source 6 irradiates on the reflecting cup 26 after passing through the light distribution lens 25, and is reflected out of the light-source engine, as is shown by a dotted line 27 indicating the light in the figure. The reflecting cup 26 in the figure is formed from the front shell 4 stretched backwards.

Embodiment 2

Figure 25:
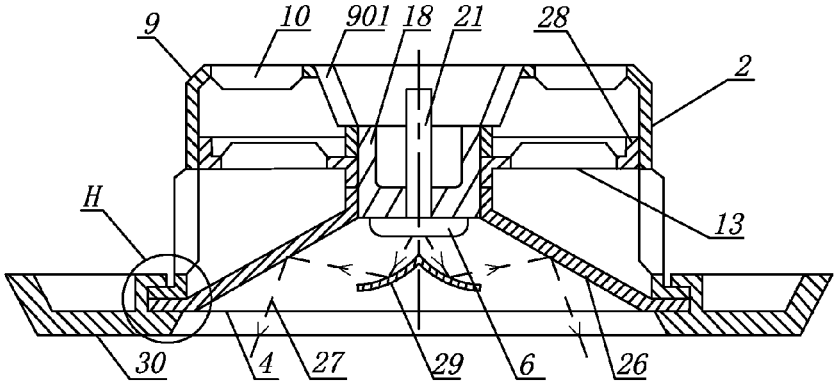

As is shown in FIG. 25, at the front of the solid-state light source 6 there is a lamp wick reflector 29, the lamp wick reflector 29 reflects more than one half of the light transmitted from the solid-state light source 6 to the reflecting cup 26, as is shown by the dotted line 27 indicating light in the figure. The reflecting cup 26 in the figure is formed by the front shell 4 being stretched backwards.

Figure 26:
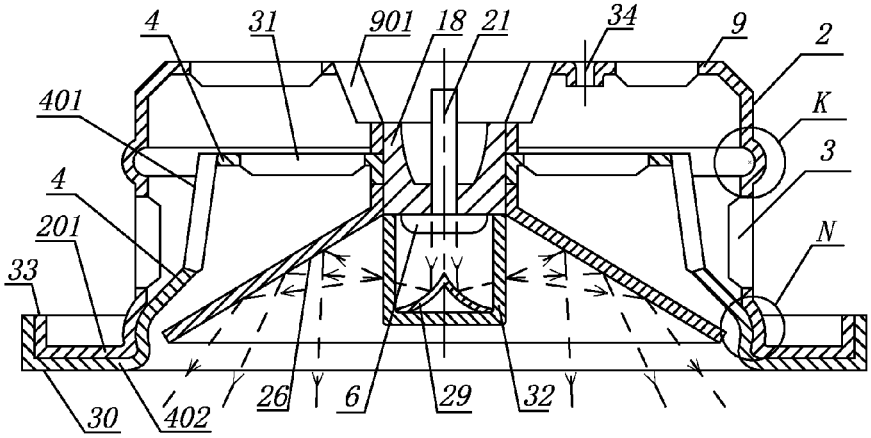

Embodiment 3 as is shown in FIG. 26, at the front of the solid-state light source 6 there are a lamp wick cover 32 and a lamp wick reflector 29 which is within the lamp wick cover 32, the lamp wick cover 32 is provided with a side wall facing the reflecting cup 26, the side wall adopts an astigmatic structure or is made of an astigmatic material, the light irradiating on the side wall of the lamp wick cover 32, whether being from the solid-state light source 6 directly or being reflected from the lamp wick reflector 29, produces diffuse scattering after passing through the astigmatic structure or the astigmatic material of the side wall of the lamp wick cover 32, and irradiates on the reflecting cup 26, and then is reflected out of the reflecting cup 26, as is shown by the dotted line 27 indicating light in the figure.

Figure 27:
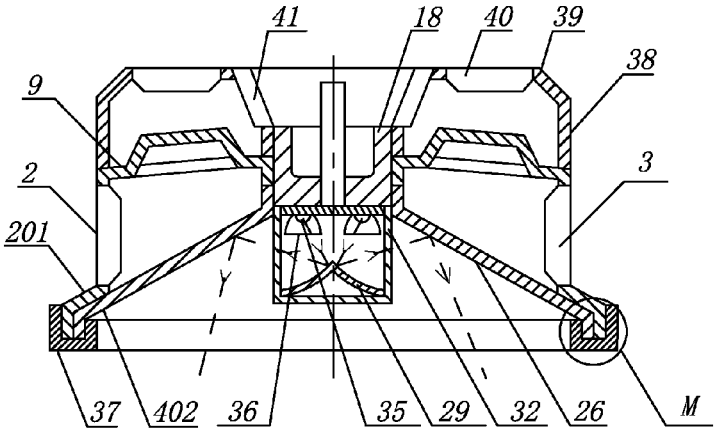

The solid-state light source engine shown by FIG. 27 of the invention is provided with the lamp wick cover 32, the light-source lamp bead 35 is provided with a spotlight cup 36. The heat conduction core 18, the solid-state light source 6, the lamp wick reflector 29 and the lamp wick cover 32 can constitute one independent standard component—a solid-state light lamp core.

In FIG. 24, the fastening connection between the front shell 4 and the side wall 2 adopts the buckle connection structure, as is shown in the local part G in the figure, and which is similar to FIG. 13, the edge of the side wall 2 is packed by the edge of the front shell 4 and provided with a light-admitting lamp cover 24 also.

In FIG. 25, the outer edge of the fin 13 in the heat dissipation metal shell is provided with an outer bend-edge 28 which contacts the inner wall of the side wall 2, the contacting surface therebetween may be the contact heat-transfer surface. The figure also shows a panel 30 which may function as decoration, the fastening connection between the edge of the side wall 2 and that of the front shell 4 adopts a peripheral accessory pressing connection structure, a peripheral accessory is positioned on the panel 30, as is shown in the local part H of the figure.

In FIG. 26, the front shell 4 is provided with the ventilation window 31 and is stretched backwards, the stretched wall is provided thereon with a louver structure ventilation window 401. A cavity formed by the backwards stretched front shell 4, the reflecting cup 26 is within the cavity. The reflecting cup 26 adopts the sleeve structure constituting the contact heat-transfer surface between the reflecting cup 26 and the heat conduction core 18, the reflecting cup is used also for heat dissipation. the reflecting cup 26 shall be made of metal material and had better be made of an aluminium plate.

FIG. 26 also shows that: the panel 30 is formed by the extending section 402 of the front shell 4, the extending section 201 of the side wall 2 extends to be at the back of the panel 30 and constitutes a back reinforcing plate 33 of the panel 30. The panel 30 can also be designed to consist of the extending section 201 of the side wall 2. The local part N of the figure shows the fastening connection structure between the edge of the front shell 4 and that of the side wall 2, which shall belong to a buckle connection structure.

In FIG. 27, at the back of the rear shell 9 there is a rear outer shell 39, the stretched wall 38 of the outer edge of the rear outer shell 39 is made by the stretch of the metal plate from the rear outer shell 39, the stretched wall 38 can also be provided with a louver type or staggered structure ventilation window. The rear outer shell 39 is provided thereon with a ventilation window 40 of a louver type structure (it can also adopt the staggered type structure), the cut line of the ventilation window shall be in radiation shape; the middle part of the rear outer shell 39 adopts a structure stretched forwards, the stretched wall is provided thereon with a ventilation window 41 of a louver type structure (it can also adopt a staggered structure), the contact heat transfer between the rear outer shell 39 and the heat conduction core 18 is direct contact heat transfer in the figure and also can be designed to be indirect contact heat transfer. The figure also shows that the fastening connection between the extending section 201 of the side wall 2 and the extending section 402 of the front shell 4 adopts a peripheral accessory clamping connection structure, an outer reinforced ring 37 in the figure is the peripheral accessory.

The effective ventilation area of a louver type structure ventilation window in the invention is defined as: referring to FIG. 4, the effective ventilation area of a single opening is equal to the product of the width b of the opening 16 multiplied by the length of the opening 16, the sum of the effective ventilation area of all the openings is the effective ventilation area of the whole louver type ventilation window.

The effective ventilation area of a staggered structure ventilation window in the invention is defined as, referring to FIG. 3:

When the width b of the opening 16 is less than or equal to one half of the width c of the fin 15*b*, the effective ventilation area constituted by a single fin 15*b* is equal to the product of the 2*b* multiplied by the length of the opening 16, the sum of the effective ventilation area constituted by all the fins 15*b* is the effective ventilation area of the whole staggered ventilation window.

When the width b of the opening 16 is bigger than one half of the width c of the fin 15*b*, if the width c of the fin 15*b* is less than or equal to the width e of the fin 15*a*, the effective ventilation area constituted by a single sheet 15*b* is equal to c multiplied by the length of the opening 16, the sum of the effective ventilation area constituted by all the fins 15*b* is the effective ventilation area of the whole staggered structure ventilation window; if c is bigger than e, the calculation is carried out according to the fin 15*a*, the effective ventilation area of a single fin 15*a* is equal to the product of e multiplied by the length of the opening 16, the sum of the effective ventilation area of all the fins 15*a* is the effective ventilation area of the whole staggered structure ventilation window.

According to the above definition, the maximum theoretical value of the permeation rate of a staggered structure ventilation window is 0.5, the permeation rate of the side wall 2 proposed in the invention shall be 0.2, and is 40% of the maximum theoretical value, which indicates that it is big enough.

Figure 28:
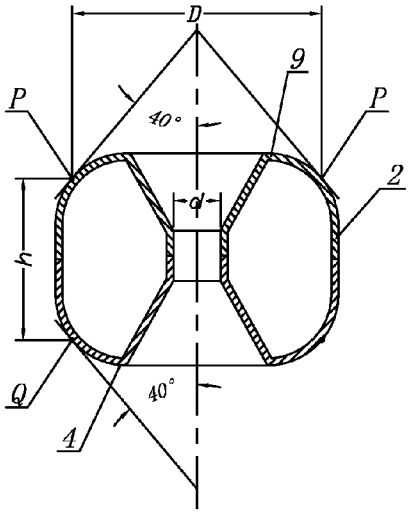
FIG. 28 and FIG. 29 are diagrams for determining the dividing points of a side wall, a rear shell and a front shell of a heat dissipation metal shell of the invention.

The permeation rate of the side wall 2 of the invention is defined as the quotient obtained by the effective ventilation area of the ventilation window of the side wall 2 divided by the area of the side wall 2, the effective ventilation area of a louver type or staggered structure ventilation window is calculated based on the above definition. The area of the side wall 2 is calculated based on the followings:

When the side wall 2 is in arc connection with the front shall 4 and the rear shell 9, the tangent point is adopted when the included angle of arc tangent line and an axis is 40°, such as point P and point Q in FIG. 28, and thus the demarcation point of the side wall 2 as well as the rear shell 9 and the front shell 4 is determined, the area of the outer surface in h in FIG. 28 is the area of the side wall 2.

Figure 29:
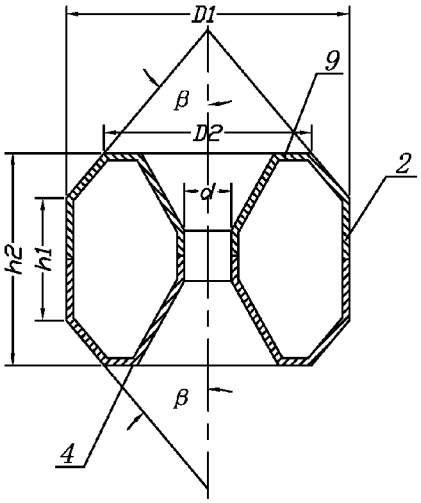

When the side wall 2 as well as the front shell 4 and the rear shell 9 are in cant connection, as is shown in FIG. 29, if the included angle β of the cant and the axis is bigger than 40°, the area of the side wall 2 is calculated according to the area of the outer surface in h2, if the included angle β of the cant and the axis is less than or equal to 40°, the area of the side wall 2 is calculated according to the area of the outer surface in h1.

The theoretic limit of the permeation rate of the louver structure ventilation window is 1.0, however, due to the factors such as heat conduction, wall thickness, strength and processing, the actually realized permeation rate is very low, for the heat dissipation metal shell 1 shown in FIG. 12, the open porosity of the ventilation window 3 of the side wall 2 is very high while the permeation rate of the side wall 2 is only about 0.4.

The permeation rate of the side wall 2 proposed by the invention shall not be less than 0.2 based on experiments and theoretical analysis: according to the experiments and the theoretical analysis, the difference between the heat dissipation performance can reach 50% when the permeation rate of the side wall 2 is within the range of 0.2-0.4, the difference between the heat dissipation performance can reach one time when the permeation rate of the side wall 2 is within the range of 0.1-0.4, the heat dissipation performance of the permeation rate of the side wall 2 of 0.2 is higher by one time than that of the side wall 2 of 0 (without the ventilation window). When a product is actually designed, the minimum permeation rate of the side wall 2 shall reach 0.3, because when the processing is taken into account, the permeation rate of the side wall 2 of 0.3 is easily achieved while the heat dissipation performance is also very high.

The ventilation window provided on the rear shell 9, the fin 13 and the rear outer shell 39 shall also be large enough, their permeation rate shall at least reach 0.2 to ensure smooth convection of airflow, in an actual product design, the permeation rate shall reach more than 0.3.

The permeation rate of the rear shell 9 of the invention is defined to be the quotient obtained by the effective ventilation area of all the ventilation windows divided by the projection area of the rear shell 9 in the axis direction. The effective ventilation area of the louver type or staggered structure ventilation window is calculated based on the above definition.

The projection area of the rear shell 9 in the axis direction is defined to be the difference of the area of the diameter D reduced by the area of the diameter d in FIG. 28. In FIG. 29, if angle β is bigger than 40°, the projection area is the difference of the area of the diameter of D1 reduced by the area of the diameter d; if angle β is less than or equal to 40°, the projection area is the difference of the area of the diameter of D2 reduced by the area of the diameter d. The definition and calculation of the permeation rate of the rear outer shell 39, the fin 13 shall conform to the permeation rate of the rear shell 9.

If the thickness of the metal plate is reduced, the cost may be reduced, but there are factors reducing the heat dissipation amount. The influence of the thickness of the wall on heat transfer is in a curvilinear relation, the influence of the thickness of the wall on heat transfer can be analyzed with fin efficiency conception to ensure a reasonable value of the thickness of the wall of the heat dissipation metal shell 1.

The fin efficiency is defined to be the quotient obtained by actual heat dissipation amount divided by the heat dissipation amount obtained when the fin does not have thermal-conduction resistance therein (that is, the coefficient of thermal conductivity of the fin material is infinite). Based on the parameters obtained through experiments, with a computer numerical simulation analysis, the influence of the thickness of the wall on the fin efficiency is obtained when the heat dissipation metal shell 1 is made of aluminum material in the invention.

When the diameter of the side wall 2 is 180 mm and the thickness of the wall is 1.0 mm, the fin efficiency is 64%, when the thickness of the wall is increased to be 1.2 mm, that is, it is increased by 20%, the fin efficiency is increased by only 5.5%; when the thickness of the wall is increased to be 1.5 mm, that is, it is increased by 50%, the fin efficiency is increased by only 12%.

When the diameter of the side wall 2 is 150 mm and the thickness of the wall is 0.8 mm, the fin efficiency is 68%. When the thickness of the wall is increased to be 1.0 mm, that is, it is increased by 25%, the fin efficiency is increased by only 6%, when the thickness of the wall is increased to be 1.3 mm, that is, it is increased by 62%, the fin efficiency is increased by only 12%.

When the diameter of the side wall 2 is 130 mm and the thickness of the wall is 0.7 mm, the fin efficiency is 70%, when the thickness of the wall is increased to be 0.9 mm, that is, it is increased by 28%, the fin efficiency is increased by only 6.5%, when the thickness is increased to be 1.15 mm, that is, it is increased by 64%, the fin efficiency is increased by only 12.5%.

When the diameter of the side wall 2 is 115 mm and the thickness of the wall is 0.6 mm, the fin efficiency is 68%, when the thickness of the wall is increased to be 0.8 mm, that is, it is increased by 33%, the fin efficiency is increased by only 7%, when the thickness is increased to be 1.0 mm, that is, it is increased by 67%, the fin efficiency is increased by only 13%.

When the diameter of the side wall 2 is 100 mm and the thickness of the wall is 0.6 mm, the fin efficiency is 74%, when the thickness of the wall is increased to be 0.8 mm, that is, it is increased by 33%, the fin efficiency is increased by only 5.5%, when the thickness is increased to be 1.0 mm, that is, it is increased by 67%, the fin efficiency is increased by only 9.5%.

When the diameter of the side wall 2 is 90 mm and the thickness of the wall is 0.5 mm, the fin efficiency is 76%, when the thickness of the wall is increased to be 0.7 mm, that is, it is increased by 40%, the fin efficiency is increased by only 6.5%, when the thickness is increased to be 0.9 mm, that is, it is increased by 80%, the fin efficiency is increased by only 9%.

When the diameter of the side wall 2 is 80 mm and the thickness of the wall is 0.5 mm, the fin efficiency is 78%, when the thickness of the wall is increased to be 0.6 mm, that is, it is increased by 40%, the fin efficiency is increased by only 6.5%, when the thickness is increased to be 0.8 mm, that is, it is increased by 60%, the fin efficiency is increased by only 9%.

When the diameter of the side wall 2 is 70 mm and the thickness of the wall is 0.4 mm, the fin efficiency is 77%, when the thickness of the wall is increased to be 0.6 mm, that is, it is increased by 50%, the fin efficiency is increased by only 7%, when the thickness is increased to be 0.7 mm, that is, it is increased by 75%, the fin efficiency is increased by only 10%

When the diameter of the side wall 2 is 60 mm and the thickness of the wall is 0.4 mm, the fin efficiency is 80%, when the thickness of the wall is increased to be 0.5 mm, that is, it is increased by 25%, the fin efficiency is increased by only 3.5%, when the thickness is increased to be 0.6 mm, that is, it is increased by 50%, the fin efficiency is increased by only 6.5%.

Based on the above results, taking the other factors (for example, structural strength, the ratio of material cost against processing cost, the influence by the whole size) into account, it is analyzed that, in an actual product design, the thickness of the wall of the heat dissipation metal shell 1 is selected as follows:

When there is 180 mm≥D>150 mm, there is δ≤1.5 mm, preferably δ<1.25 mm. When there is 150 mm≥D>130 mm, there is δ≤1.3 mm, preferably δ<1.1 mm. When there is 130 mm≥D>115 mm, there is δ≤1.15 mm, preferably δ<0.95 mm. When there is 115 mm≥D>100 mm, there is δ≤1.0 mm, preferably δ<0.85 mm. When there is 100 mm≥D>90 mm, there is δ≤0.95 mm, preferably δ<0.8 mm. When there is 90 mm≥D>80 mm, there is δ≤0.9 mm, preferably δ<0.75 mm. When there is 80 mm≥D>70 mm, there is δ≤0.85 mm, preferably δ<0.7 mm. When there is 70 mm≥D>60 mm, there is δ≤0.8 mm, preferably δ<0.65 mm. When there is D≤60 mm, there is δ≤0.7 mm, preferably δ<0.6 mm.

D represents the diameter of the side wall 2, δ represents the thickness of the wall of the heat dissipation metal shell 1.

When the diameter of the side wall 2 is not uniform, the average value of the maximum value and the minimum value (the average diameter) is obtained; when the cross section of the side wall 2 is not circular, the equivalent diameter of equal area is obtained, for example, for a square of which the cross section of the side wall 2 has side length E, there is its equivalent diameter of $D=2E/\sqrt{\pi}=1.12E$; when the thickness of the wall is not uniform, the average value of the side wall thickness (average thickness) is obtained.

It will thus be seen that the objects of the invention have been fully and effectively accomplished. The embodiments have been shown and described for the purposes of illustrating the functional and structural principles of the invention and is subject to change without departure from such principles. Therefore, this invention includes all modifications encompassed within the spirit and scope of the following claims.

What is claimed is:

1. A solid-state light source heat dissipation metal shell, comprising a side wall the convection heat dissipation of the heat dissipation metal shell adopts a method of natural convection heat transfer, characterized in that:

the heat dissipation metal shell includes a front shell, the side wall and the front shell are made of the same piece of metal plate, the middle of the front shell is provided with a contact heat-transfer surface directly or indirectly in contact with a solid-state light source, or the heat dissipation metal shell includes a rear shell, the side wall and the rear shell are made of the same piece of metal plate, the middle of the rear shell is provided with a contact heat-transfer surface directly or indirectly in contact with a solid-state light source, or the heat dissipation metal shell includes a rear shell and a front shell, a part of the side wall and the front shell are made of the same piece of metal plate, and a part of the side wall and the rear shell are made of the same piece of metal plate, the middles of the rear shell and the front shell are provided with contact heat-transfer surfaces directly or indirectly in contact with a solid-state light source, the side wall is provided with a ventilation window with a louver type structure or a staggered structure, a cut line of the ventilation window adopts a structure along the axis direction of the heat dissipation metal shell.

2. The heat dissipation metal shell, as recited in claim 1, characterized in that the permeation ratio of the side wall is not less than 0.20.

3. The heat dissipation metal shell, as recited in claim 2, characterized in that: the permeation ratio of the side wall is not less than 0.30.

4. The heat dissipation metal shell, as recited in claim 1, characterized in that:

when there is 180 mm≥D>150 mm, there is δ≤1.5 mm,
when there is 150 mm≥D>130 mm, there is δ≤1.3 mm,
when there is 130 mm≥D>115 mm, there is δ≤1.15 mm,
when there is 115 mm≥D>100 mm, there is δ≤1.0 mm,
when there is 100 mm≥D>90 mm, there is δ≤0.95 mm,
when there is 90 mm≥D>80 mm, there is δ≤0.9 mm,
when there is 80 mm≥D>70 mm, there is δ≤0.85 mm,
when there is 70 mm≥D>60 mm, there is δ≤0.8 mm, when there is D≤60 mm, there is δ≤0.7 mm, wherein D represents the equivalent diameter of the side wall, δ represents the average thickness of the wall of the heat dissipation metal shell.

5. The heat dissipation metal shell, as recited in claim 1, characterized in that: the side wall is formed by a stretch method from the same piece of the metal plate of the rear shell, or the front shell, or the rear shell and the front shell.

6. The heat dissipation metal shell, as recited in claim 5, characterized in that the heat dissipation metal shell is provided with an outer edge surface, an inwardly bent fin of the ventilation on the side, wall is connected directly with the outer edge surface, the junction is a bend-edge, the other end of the inwardly bent fin is connected with a lower end connection piece, the junction is a lower, bend-edge.

7. A method for producing an solid-state light source heat dissipation metal shell as recited in claim 6, characterized in that: for the shaped method with a louver type or staggered structure ventilation window, on the side wall, a shaped convex tooth moves in the axial direction of the heat dissipation metal shell, pushes a metal shell wall of the side wall to be deformed inwardly, and thus the inwardly bent fin is formed and a ventilation opening is formed.

8. The method, as recited in claim 7, characterized in that the process of a edge surface cut line and a side wall cut line as well as the process of the shaped convex tooth pushing anally are in the same mold station.

9. The heat dissipation metal shell, as recited in claim 5, characterized in that: when the heat dissipation metal shell is provided with the rear shell, the rear shell adopts a structure stretched forwards and is provided with a ventilation window with a louver type structure or a staggered structure, a cut line of the ventilation window adopts a structure along the stretch direction.

10. The heat dissipation metal shell, as recited in claim 5, characterized in that: when the heat dissipation metal shell is provided with the front shell, the front shell adopts a structure stretched backwards and is provided with a ventilation window with a louver type structure or staggered structure, a cut line of the ventilation window adopts a structure along the stretch direction.

11. The host dissipation metal shell, as recited in claim 1, characterized in that: when the heat dissipation metal shell is provided with the rear shell, the rear shell is provided with a ventilation window with a louver type structure or staggered structure, a cut line of the ventilation window adopts a structure in radiation shape-.

12. The heat dissipation metal shell, as recited in claim 11, characterized in that: the permeation rate of the rear shell is not less than 0.20.

13. The heat dissipation metal shell, as recited in claim 1, characterized in that: when the heat dissipation metal shell is provided with the front shell, the front, shell is provided with a ventilation window with a louver type structure or staggered structure, a cut line of the ventilation window adopts a structure in radiation shape.

14. The heat dissipation metal shell, as recited in claim 1, characterized in that: when the heat dissipation metal shell has the front shell and the rear shell, and the side wall and the rear shell are made of the same piece of metal plate, a fastening connection structure is provided between the edge of the side wall or the side-wall extending section and the edge of the front shell or the front-shell extending section.

15. The heat dissipation metal shell, as recited in claim 14, characterized in that the fastening connection between the edge of the side wall or the side-wall extending section and the edge of the front shell or the front-shell emending section adopts a buckle connection.

16. The heat dissipation metal shell, as recited in claim 1, characterized in that: a panel is provided, the side wall has a sidewall extending section, the side-wall extending section extends to be at the back of the panel.

17. The heat dissipation metal shell, as recited in claim 1, characterized in that the heat dissipation metal shell is provided therein with a fin with a sleeve structure or a lamination structure, a ventilation window with a louver type structure or a staggered structure is provided on the fin, a cut line of the ventilation window adopts a structure in radiation shape; the outer edge of the fin has a outer bend-edge.

18. An solid-state light source engine, comprising a heat dissipation metal shell, a solid-state light source, the heat dissipation metal shell comprises a side wall the convection heat dissipation of the heat dissipation metal shell adopts a method of natural convection heat transfer, characterized in that:

the heat dissipation metal shell includes a front shell, the side wall is formed by a stretch method from the same piece of metal plate of the front shell, the middle of the front shell is provided with a contact heat-transfer surface directly or indirectly in contact with the solid-state light source, or the heat dissipation metal shell includes a rear shell, the side wall is formed by a stretch method from the same piece of metal plate of the rear shell, the middle of the rear shell is provided with a contact heat-transfer surface directly or indirectly in contact with the solid-state light source; or the heat dissipation metal shell includes a rear, shell and a front shell, the side wall is formed by a stretch method, a part from the same piece of metal plate of the front shell and a part from the same piece of metal plate of rear shell, the middles of the rear-shell and the front shell are provided with contact heat-transfer surfaces directly or indirectly in contact with the solid-state light source, the side wall is provided thereon with a ventilation window in a louver type structure or a staggered structure, a cut line of the ventilation window adopts a structure along the stretch direction of the side wall, the solid-state light source is provided with a reflecting cup; the front side of the solid-state light source is provided with a light distribution lens, after passing through the light distribution lens, more than one half of the light transmitted from the solid-state light source irradiates on the reflecting cup and is reflected out of the light source engine, or the front side of the solid-state light source is provided with a lamp wick reflector, the lamp wick reflector reflects more than one half of the light transmitted from the solid-state light source to the reflecting cup and is reflected out of the light-source engine, or the front side of the solid-state light source is provided with a lamp-wick cover, the lamp wick cover is provided with a side wall facing the reflecting cup, the side wall of the lamp wick cover adopts an astigmatic structure or is made of an astigmatic material.

19. The solid-state light source engine, as recited in claim 18, characterized in that when the heat dissipation metal shell is provided with the front shell, the front shell adopts a structure stretched backwards and the reflecting cup is formed by the front shell being stretched backwards.

20. The solid-state light source engine, as recited, in claim 18, characterized in that when the heat dissipation metal shell is provided with the front shell, the front shell adopts a structure stretched backwards, a ventilation window with a louver type structure or staggered, structure is provided on the stretched backwards wall of the front shell, a cut line of the ventilation window adopts a structure along the stretch direction, a cavity formed by the backwards stretched front shell is provided therein with a reflecting cup.

* * * * *